US008940671B2

(12) United States Patent
Basu

(10) Patent No.: US 8,940,671 B2
(45) **Date of Patent: *Jan. 27, 2015**

(54) LUBRICATING COMPOSITION CONTAINING A MALIC ACID DERIVATIVE

(75) Inventor: Shubhamita Basu, Willoughby, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/319,127

(22) PCT Filed: May 10, 2010

(86) PCT No.: PCT/US2010/034165

§ 371 (c)(1),
(2), (4) Date: Jan. 25, 2012

(87) PCT Pub. No.: WO2010/132320

PCT Pub. Date: Nov. 18, 2010

(65) Prior Publication Data

US 2012/0115761 A1 May 10, 2012

Related U.S. Application Data

(60) Provisional application No. 61/177,766, filed on May 13, 2009.

(51) Int. Cl.

| | |
|---|---|
| ***C10M 125/26*** | (2006.01) |
| ***C10M 135/36*** | (2006.01) |
| ***C10M 133/16*** | (2006.01) |

(52) U.S. Cl.

CPC ..... *C10M 133/16* (2013.01); *C10M 2215/086* (2013.01); *C10M 2215/28* (2013.01); *C10M 2219/022* (2013.01); *C10M 2219/08* (2013.01); *C10M 2219/106* (2013.01); *C10M 2223/043* (2013.01); *C10M 2223/10* (2013.01); *C10M 2227/061* (2013.01); *C10N 2230/06* (2013.01); *C10N 2240/04* (2013.01); *C10N 2240/042* (2013.01); *C10N 2240/044* (2013.01); *C10N 2240/045* (2013.01); *C10N 2240/046* (2013.01); *C10N 2260/14* (2013.01)

USPC ..... 508/156; 508/186; 508/272; 508/290; 508/291

(58) Field of Classification Search

USPC ..... 508/156, 290, 291, 272, 186

See application file for complete search history.

(56) References Cited

U.S. PATENT DOCUMENTS

| | | | |
|---|---|---|---|
| 2,977,309 | A | 3/1961 | Godfrey et al. |
| 3,284,409 | A | 11/1966 | Dorer |
| 3,825,495 | A | 7/1974 | Newingham et al. |
| 4,180,466 | A | 12/1979 | Newingham et al. |
| 4,308,154 | A | 12/1981 | Clason et al. |
| 5,487,838 | A | 1/1996 | Luciani et al. |
| 5,547,596 | A | 8/1996 | Omiya |
| 2002/0119895 | A1 | 8/2002 | Cook et al. |
| 2008/0014646 | A1 | 1/2008 | Kuroda et al. |
| 2008/0146464 | A1 | 6/2008 | Malwitz |
| 2008/0274921 | A1 * | 11/2008 | MacPherson et al. ..... 508/287 |

FOREIGN PATENT DOCUMENTS

| | | |
|---|---|---|
| EP | 0 399 764 | 11/1990 |
| WO | 9637585 | 11/1996 |
| WO | WO 96/37585 | 11/1996 |
| WO | 2008147704 | 12/2008 |
| WO | WO 2008/147704 | 12/2008 |
| WO | 2010132229 | 11/2010 |
| WO | 2010132318 | 11/2010 |
| WO | WO 2010/132229 | 11/2010 |
| WO | WO 2010/132318 | 11/2010 |

OTHER PUBLICATIONS

Corresponding Publication No. WO 2010/132320 A1 and Search Report published Nov. 18, 2010.

Written Opinion for corresponding International Application No. PCT/US2010/034165 dated Jun. 22, 2010.

* cited by examiner

*Primary Examiner* — Vishal Vasisth

(74) *Attorney, Agent, or Firm* — Michael F. Esposito, Esq.; David M. Shold, Esq.

(57) ABSTRACT

The invention relates to a lubricating composition containing (a) an N-substituted malimide, and (b) an oil of lubricating viscosity. The invention further provides for the use of the lubricating composition for lubricating a limited slip differential.

11 Claims, No Drawings

LUBRICATING COMPOSITION CONTAINING A MALIC ACID DERIVATIVE

This application is a 371 of PCT/US2010/034165, filed May 10, 2010 which claims benefit of 61/177,766, filed May 13,2009.

FIELD OF INVENTION

The invention relates to a lubricating composition containing (a) an N-substituted malimide, and (b) an oil of lubricating viscosity. The invention further provides for the use of the lubricating composition for lubricating a limited slip differential.

BACKGROUND OF THE INVENTION

A limited slip differential in a vehicle typically employs a wet multi-plate clutch, i.e., clutch plates are immersed in a lubricant. The limited slip differential typically has bevel gear or spur gear planetary systems which distribute the drive torque evenly to the two driving wheels irrespective of their rotational speed. This makes it possible for the driven wheels to roll during cornering without slip between the wheel and road surface in spite of their different rotational speed. In order for the slip to be controlled lubricants containing compounds capable of improving friction performance, dispersants and sulphur- and/or phosphorus-containing extreme pressure agents may be used. Examples of lubricants of this type are disclosed in U.S. Pat. Nos. 4,308,154; 5,547,586; 4,180,466; 3,825,495; and European Patent Application 0 399 764 A1.

Lubricants containing compounds suitable for (i) deposit control (U.S. Pat. No. 3,284,409), and (ii) wear performance are described in International Application WO 96/037585, US Patent Application 2002/0119895, and U.S. Pat. No. 5,487,838.

SUMMARY OF THE INVENTION

The inventors of this invention have discovered that a lubricating composition and method as disclosed herein is capable of providing an acceptable level of at least one of (i) lubricant thermal stability, (ii) lubricant oxidative stability, (iii) high static coefficient of friction, (iv) fuel economy, (v) deposit control, (vi) seal compatibility, (vii) cleanliness and (viii) low tendency towards noise, vibration and harshness (NVH) often manifested as chatter (i.e. an abnormal noise typically referred to as a low-frequency "growl" and "groan", particularly during higher-speed cornering manoeuvres). The inventors have also discovered that the lubricant composition and method disclosed herein unexpectedly may also be suitable for limited slip systems having one or more distinct plate materials. For example the plate materials may be steel, paper, ceramic, carbon fibers and systems employing a mixture of plate types such as steel on ceramic, carbon fibers in paper or steel on paper.

In one embodiment, the invention provides a method of lubricating a limited slip differential comprising supplying to the limited slip differential a lubricating composition comprising (a) an N-substituted malimide, and (b) an oil of lubricating viscosity.

In one embodiment, the invention provides for the use of a lubricating composition comprising (a) an N-substituted malimide, and (b) an oil of lubricating viscosity in a limited slip differential to provide an acceptable level of at least one of (i) lubricant thermal stability, (ii) lubricant oxidative stability, (iii) friction coefficient, (iv) fuel economy, (v) deposit control, (vi) seal compatibility, and (vii) chattering (abnormal noise). In one embodiment the use provides an acceptable level of friction, i.e., friction coefficient.

In one embodiment the invention provides for the use of the N-substituted malimide as a friction modifier in a lubricant (particularly an axle lubricant for a limited slip differential.

DETAILED DESCRIPTION OF THE INVENTION

The present invention provides a lubricating composition and method as disclosed herein above.

N-Substituted Malimide

As used herein the term "alk(en)yl" includes both alkyl and alkenyl groups.

The lubricating composition disclosed herein contains an N-substituted malimide (may also be referred to as a malimide), or mixtures thereof. The N-substituted malimide has an N-hydrocarbyl substituent group which may be an alk(en)yl group. The alk(en)yl group may contain 1 to 30, or 6 to 26, or 8 to 20 carbon atoms, with the proviso that when the N-substituted malimide comprises molecules with a hydrocarbyl group of less than 8 carbon atoms, then the N-substituted malimide is in the form of a mixture of N-substituted malimides and the hydrocarbyl groups in said mixture have an average total number of carbon atoms of at least 6, or at least 10.

The N-substituted malimide may be represented by formula (1) or formula (2) as described herein. Typically the N-substituted malimide may be represented by formula (1).

In one embodiment the N-substituted hydrocarbyl malimide may be represented by formula (1):

formula (1)

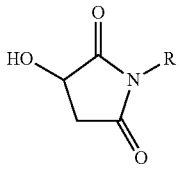

wherein R may be a linear, branched or cyclic hydrocarbyl group (typically a linear or branched hydrocarbyl group) containing 1 to 30, or 8 to 20 carbon atoms, with the proviso that when the N-substituted malimide comprises molecules with a hydrocarbyl group of less than 8 carbon atoms, then the N-substituted malimide is in the form of a mixture of N-substituted malimides and the hydrocarbyl groups in said mixture have an average total number of carbon atoms of at least 6, or at least 7, or at least 10.

In one embodiment the R hydrocarbyl group may include an alkyl group such as 2-ethylhexyl, nonyl, decyl, undecyl, dodecyl, tridecyl, tetradecyl, pentadecyl, hexadecyl, heptadecyl, octadecyl, nonadecyl, eicosyl, or mixtures thereof.

When the R hydrocarbyl group is an alkenyl group, examples include cis and trans including 8-octadecenyl, 9-octadecenyl, 10-octadecenyl, 8-hexadecenyl, 9-hexadecenyl, 10-hexadecenyl, 8-eicosenyl, 9-eicosenyl, 10-eicosenyl, or mixtures thereof.

In one embodiment the R hydrocarbyl group may include oleyl (cis-9-octadecenyl), coco, tallow, lauryl, stearyl, or mixtures thereof. N-substituted malimide compounds having these R groups may be named as N-substituted oleyl malimide, N-substituted coco malimide, N-substituted tallow malimide, N-substituted lauryl malimide and N-substituted stearyl malimide.

The N-substituted malimide may be prepared by a process comprising reacting a primary amine with malic acid or esters thereof. The primary amine has an alk(en)yl group typically containing 1 to 30, 6 to 30, or 8 to 20 carbon atoms.

Examples of a primary amine may be selected from the category of amines which may be generally described as hydrocarbyl amines (typically alkyl amines, or alkenyl amines). The hydrocarbyl group of the amine, that is, a hydrocarbyl group attached to the, or attached to an, amino nitrogen, may be described as a long chain hydrocarbyl group, by which is meant generally a hydrocarbyl group containing 8 to 30, or 8 to 20, or 12 to 22 carbon atoms. The hydrocarbyl group may include a mixture of individual groups on different molecules having a variety of carbon numbers falling generally within the range of 8 to 30, or 8 to 20, or 12 to 20 carbon atoms, although molecules with hydrocarbyl groups falling outside this range may also be present. If a mixture of hydrocarbyl groups is present, they may be primarily of even carbon number (e.g., 12, 14, 16, 18, 20, 22) as is characteristic of groups derived from many naturally-occurring materials, or they may be a mixture of even and odd carbon numbers or, alternatively, an odd carbon number or a mixture of odd numbers. They may be branched, linear, or cyclic and may be saturated or unsaturated, or combinations thereof. In certain embodiments the hydrocarbyl groups may contain 16 to 18 carbon atoms, and sometimes predominantly 16 or predominantly 18. Specific examples include mixed "coco" groups from cocoamine (predominantly C12 and C14 amines) and mixed "tallow" groups from tallowamine (predominantly C16 and C18 groups), and isostearyl groups.

The reaction of the primary amine with malic acid or esters may be performed in a variety of different reaction conditions. The reaction may be carried out at a reaction temperature in the range of 50° C. to 200° C., or 120° C. to 180° C., or 130° C. to 170° C. The reaction may be carried out in an inert atmosphere e.g., under nitrogen, or argon, typically nitrogen. The reaction may be performed in the presence or absence of a solvent (typically including a solvent). The solvent includes or may include an aromatic hydrocarbon solvent.

Examples of an aromatic hydrocarbon solvent include aromatic hydrocarbon solvent, including Shellsolv AB® (commercially available from Shell Chemical Company); and toluene extract, xylene Aromatic™ 200, Aromatic™ 150, Aromatic™ 100, Solvesso™ 200, Solvesso™ 150, Solvesso™ 100, HAN 857® all commercially available from Exxon Chemical Company or mixtures thereof. Other aromatic hydrocarbon solvents include xylene, toluene, or mixtures thereof.

In one embodiment the N-substituted malimide may be an N(N',N'-dihydrocarbylaminoalkyl)malimide. In another embodiment, the N-substituted malimide may be an N(N'-hydrocarbylaminoalkyl)malimide. In yet another embodiment, the N-substituted malimide may be mixtures of such materials.

In one embodiment the N(N'-hydrocarbylaminoalkyl)malimide or N(N',N'-dihydrocarbylaminoalkyl)malimide may be represented by formula (2):

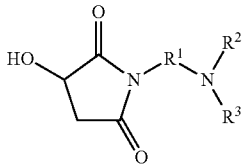

wherein $R^1$ may be a hydrocarbylene typically containing 1 to 6, 1 to 4, 2 to 3 or 3 carbon atoms; and $R^2$ and $R^3$ may each independently be hydrogen or a hydrocarbyl group (such as a linear, branched or cyclic hydrocarbyl group containing 1 to 30, or 8 to 20 carbon atoms (typically the hydrocarbyl group may be linear or branched);

with the proviso that when the N-substituted malimide comprises molecules with a hydrocarbyl group of less than 8 carbon atoms, then the N-substituted malimide is in the form of a mixture of N-substituted malimides and the hydrocarbyl groups in said mixture have an average total number of carbon atoms of at least 6, or at least 7, or at least 10, and with the proviso that $R^2$ and $R^3$ are not simultaneously both hydrogen.

In one embodiment the N(N',N'-dihydrocarbylaminoalkyl) malimide of formula (2) has both $R^2$ and $R^3$ defined as a hydrocarbyl group (typically the same hydrocarbyl group e.g., $R^2$ and $R^3$ are both lauryl, or both stearyl, or both coco, or both tallow).

The N(N',N'-dihydrocarbylaminoalkyl)malimide or N(N'-hydrocarbylaminoalkyl)malimide may be prepared by a process comprising reacting malic acid or esters with an amine represented by the formula:

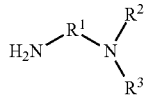

wherein $R^1$, $R^2$ and $R^3$ are defined above.

The amine may be a polyamine in the "Duomeen®" series, available from Akzo Nobel. The polyamine may be prepared by the addition a monoamine $R^2R^3NH$ to acrylonitrile, followed by catalytic reduction of the resulting nitrile compound, using, e.g., $H_2$ over Pd/C catalyst, to give the diamine.

Examples of N(N',N'-dihydrocarbylaminoalkyl)malimide compounds include N(N',N'-dicocoaminopropyl)malimide, N(N',N'-dilaurylaminopropyl)-malimide, N(N',N'-dioleylaminopropyl)malimide, N(N',N'-distearylaminopropyl) malimide, N(N',N'-coco-tallowaminopropyl)malimide, N(N',N'-lauryl-oleylaminopropyl)malimide and N(N',N'-coco-stearylaminopropyl)malimide.

The reaction conditions (relating to reaction temperature, solvent, and atmosphere) to prepare the N(N',N'-dihydrocarbylaminoalkyl)malimide or N(N'-hydrocarbylaminoalkyl) malimide include a reaction temperature in the range of 50° C. to less than 140° C., or 90° C. to 135° C., or 100° C. to 130° C. The reaction may be carried out in an inert atmosphere e.g., under nitrogen, or argon, typically nitrogen. The reaction may be performed in the presence or absence of a solvent (typically including a solvent). The solvent may include an aromatic hydrocarbon solvent. The solvent may be similar to those listed above, except for the preparation of the N(N',N'-dihydrocarbylaminoalkyl)malimide where toluene is particularly useful.

The N-substituted malimide may be present in the lubricating composition in an amount in the range of 0.1 wt % to 5 wt %, or 0.2 wt % to 3 wt %, or greater than 0.2 wt % to 3 wt % of the lubricating composition.

Amine Salt of a Phosphoric Acid Ester

In one embodiment the lubricating composition further includes an amine salt of a phosphoric acid ester. The phosphoric acid utilised to prepare the phosphoric acid ester amine salt may be either a phosphoric acid, or a thiophosphoric acid.

The amine salt of a phosphoric acid ester may contain ester groups each having 1 to 30, 6 to 30, 8 to 30, 10 to 24 or 12 to 20, or 16 to 20 carbon atoms, with the proviso that a portion or all of ester groups are sufficiently long to solubilise the amine salt of a phosphoric acid ester in an oil of lubricating viscosity. Typically ester groups containing 4 or more carbon atoms are particularly useful.

Examples of suitable ester groups include isopropyl, methyl-amyl (may also be referred to as 1,3-dimethyl butyl), 2-ethylhexyl, heptyl, octyl, nonyl, decyl, dodecyl, butadecyl, pentadecyl, hexadecyl, heptadecyl, octadecyl, nonadecyl, eicosyl, or mixtures thereof In one embodiment the ester group is selected from the group consisting of isopropyl, methyl-amyl (may also be referred to as 1,3-dimethyl butyl), 2-ethylhexyl, heptyl, octyl, nonyl, decyl, and mixtures thereof.

The amines which may be suitable for use as the amine salt include primary amines, secondary amines, tertiary amines, and mixtures thereof. The amines include those with at least one hydrocarbyl group, or, in certain embodiments, two or three hydrocarbyl groups. The hydrocarbyl groups may contain 2 to 30 carbon atoms, or in other embodiments 8 to 26, or 10 to 20, or 13 to 19 carbon atoms.

Primary amines include ethylamine, propylamine, butylamine, 2-ethylhexylamine, octylamine, and dodecylamine, as well as linear amines as n-octylamine, n-decylamine, n-dodecylamine, n-tetradecylamine, n-hexadecylamine, n-octadecylamine and oleylamine. Other useful fatty amines include commercially available fatty amines such as "Armeen®" amines (products available from Akzo Chemicals, Chicago, Ill.), such as Armeen™ C, Armeen™ O, Armeen™ OL, Armeen™ T, Armeen™ HT, Armeen™ S and Armeen™ SD, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine, ethylamylamine, dicocoamine and di-2ethylhexylamine. The secondary amines may be cyclic amines such as piperidine, piperazine and morpholine.

The amine may also be a tertiary-aliphatic primary amine, i.e., a primary amine group on a tertiary carbon, which is one having three attachments to other carbon atoms. The aliphatic group in this case may be an alkyl group containing 2 to 30, or 6 to 26, or 8 to 24 carbon atoms. Tertiary alkyl amines include monoamines such as tert-butylamine, tert-hexylamine, 1-methyl-1-amino-cyclohexane, tert-octylamine, tert-decylamine, tertdodecylamine, tert-tetradecylamine, tert-hexadecylamine, tert-octadecylamine, tert-tetracosanylamine, and tert-octacosanylamine.

The amine salt of a phosphorus acid ester may be a reaction product of a $C_{12-20}$ alkyl phosphoric acid with a tertiary $C_{11-22}$ alkyl primary amine.

In one embodiment the amine salt of a phosphorus acid ester includes an amine with C11 to C14 tertiary alkyl primary amino groups or mixtures thereof. In one embodiment the amine salt of a phosphorus compound includes an amine with C14 to C18 tertiary alkyl primary amines or mixtures thereof. In one embodiment the amine salt of a phosphorus compound includes an amine with C18 to C22 tertiary alkyl primary amines or mixtures thereof.

In one embodiment the amine salt of a phosphorus acid ester includes the reaction product of octadecenyl phosphoric acid with Primene 81R™.

Mixtures of amines may also be used in the invention. In one embodiment a useful mixture of amines is "Primene™ 81R" and "Primene™ JMT." Primene™ 81R and Primene™ JMT (both produced and sold by Rohm & Haas) are mixtures of C11 to C14 tertiary alkyl primary amines and C18 to C22 tertiary alkyl primary amines respectively.

In one embodiment the amine salt of a phosphorus acid ester is the reaction product of a C14 to C18 alkyl phosphoric acid with Primene 81R™ (produced and sold by Rohm & Haas) which is a mixture of C11 to C14 tertiary alkyl primary amines (often a mixture of mono and diesters).

Examples of the amine salt of a phosphorus acid ester include the reaction product(s) of isopropyl, methyl-amyl (1,3-dimethyl butyl or mixtures thereof), 2-ethylhexyl, heptyl, octyl, nonyl or decyl dithiophosphoric acids with ethylene diamine, morpholine, or Primene 81R™, and mixtures thereof Further examples of the amine salt of a phosphorus acid ester include the reaction product(s) of tetradecyl, pentadecyl, hexadecyl, heptadecyl, octadecyl, nonadecyl or eicosyl dithiophosphoric acids with ethylene diamine, morpholine, or Primene 81 R™, and mixtures thereof. In one embodiment the amine salt of a phosphorus acid ester includes the reaction product of octadecenyl dithiophosphoric acid with Primene 81R™.

In one embodiment the amine salt of a phosphorus compound may be an amine salt of either (i) a hydroxy-substituted di-ester of phosphoric acid, or (ii) a phosphorylated hydroxy-substituted di- or tri-ester of phosphoric acid. A more detailed description of this type of compound is described in International Publication WO 2008/094759.

In one embodiment the amine salt of a phosphoric acid is a compound described in U.S. Pat. No. 3,197,405. In one embodiment the amine salt of a phosphorus compound other than those disclosed above, may be prepared by any one of examples 1 to 25 of U.S. Pat. No. 3,197,405.

In one embodiment the amine salt of a phosphorus compound other than those disclosed above, is a reaction product prepared from a dithiophosphoric acid is reacting with an epoxide or a glycol. This reaction product is further reacted with a phosphorus acid, anhydride, or lower ester (where "lower" signifies 1 to 8, or 1 to 6, or 1 to 4, or 1 to 2 carbon atoms in the alcohol-derived portion of the ester). The epoxide includes an aliphatic epoxide or a styrene oxide. Examples of useful epoxides include ethylene oxide, propylene oxide, butene oxide, octene oxide, dodecene oxide, styrene oxide and the like. In one embodiment the epoxide is propylene oxide. The glycols include aliphatic glycols having 1 to 12, or 2 to 6, or 2 to 3 carbon atoms. The dithiophosphoric acids, glycols, epoxides, inorganic phosphorus reagents and methods of reacting the same are described in U.S. Pat. Nos. 3,197,405 and 3,544,465. The resulting acids are then salted with amines.

An example of suitable dithiophosphoric acid based product is prepared by adding phosphorus pentoxide (about 64 grams) at 58° C. over a period of 45 minutes to 514 grams of hydroxypropyl O,O-di(1,3-dimethylbutyl)phosphorodithioate (prepared by reacting di(1,3-dimethylbutyl)-phosphorodithioic acid with 1.3 moles of propylene oxide at 25° C.). The mixture is heated at 75° C. for 2.5 hours, mixed with a diatomaceous earth and filtered at 70° C. The filtrate contains 11.8% by weight phosphorus, 15.2% by weight sulphur, and an acid number of 87 (bromophenol blue).

The amine salt of a phosphorus acid ester may be present at 0 wt % to 5 wt %, or 0.01 wt % to 5 wt %, or 0.01 wt % to 2 wt %, or 0.25 wt % to 1 wt % of the lubricating composition.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056]. A more detailed description of natural and synthetic lubricating oils is described in paragraphs [0058] to [0059] respectively of WO2008/147704. Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E-API Base Oil Interchangeability Guidelines for Passenger Car Motor Oils and Diesel Engine Oils", section 1.3 Sub-heading 1.3. "Base Stock Categories". In one embodiment, the oil of lubricating viscosity may be an API Group II or Group III oil.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of these additives to the oil of lubricating viscosity and/or to diluent oil includes the ranges of 1:99 to 99:1 by weight, or 80:20 to 10:90 by weight.

Other Performance Additives

The composition of the invention optionally further includes at least one other performance additive. The other performance additives include dispersants, metal deactivators, detergents, viscosity modifiers, extreme pressure agents (typically boron- and/or sulphur- and/or phosphorus-containing), antiwear agents, antioxidants (such as hindered phenols, aminic antioxidants or molybdenum compounds), corrosion inhibitors, foam inhibitors, demulsifiers, pour point depressants, seal swelling agents, friction modifiers and mixtures thereof.

The total combined amount of the other performance additives (excluding the viscosity modifiers) present on an oil free basis may include ranges of 0 wt % to 25 wt %, or 0.01 wt % to 20 wt %, or 0.1 wt % to 15 wt % or 0.5 wt % to 10 wt %, or 1 to 5 wt % of the composition. Although one or more of the other performance additives may be present, it is common for the other performance additives to be present in different amounts relative to each other.

In one embodiment the lubricating composition is free of molybdenum-containing additives.

Viscosity Modifiers

In one embodiment, the lubricating composition further includes one or more viscosity modifiers.

When present the viscosity modifier may be present in an amount of 0.5 wt % to 70 wt %, 1 wt % to 60 wt %, or 5 wt % to 50 wt %, or 10 wt % to 50 wt % of the lubricating composition.

Viscosity modifiers include (a) polymethacrylates, (b) esterified copolymers of (i) a vinyl aromatic monomer and (ii) an unsaturated carboxylic acid, anhydride, or derivatives thereof, (c) esterified interpolymers of (i) an alpha-olefin; and (ii) an unsaturated carboxylic acid, anhydride, or derivatives thereof, or (d) hydrogenated copolymers of styrene-butadiene, (e) ethylene-propylene copolymers, (f) polyisobutenes, (g) hydrogenated styrene-isoprene polymers, (h) hydrogenated isoprene polymers, or (i) mixtures thereof.

In one embodiment the viscosity modifier includes (a) a polymethacrylate, (b) an esterified copolymer of (i) a vinyl aromatic monomer; and (ii) an unsaturated carboxylic acid, anhydride, or derivatives thereof, (c) an esterified interpolymer of (i) an alpha-olefin; and (ii) an unsaturated carboxylic acid, anhydride, or derivatives thereof, or (d) mixtures thereof.

Extreme Pressure Agents

Extreme pressure agents include compounds containing boron and/or sulphur and/or phosphorus.

The extreme pressure agent may be present in the lubricating composition at 0 wt % to 20 wt %, or 0.05 wt % to 10 wt %, or 0.1 wt % to 8 wt % of the lubricating composition.

In one embodiment the extreme pressure agent is a sulphur-containing compound. In one embodiment the sulphur-containing compound may be a sulphurised olefin, a polysulphide, or mixtures thereof.

Examples of the sulphurised olefin include a sulphurised olefin derived from propylene, isobutylene, pentene; an organic sulphide and/or polysulphide including benzyldisulphide; bis-(chlorobenzyl)disulphide; dibutyl tetrasulphide; di-tertiary butyl polysulphide; and sulphurised methyl ester of oleic acid, a sulphurised alkylphenol, a sulphurised dipentene, a sulphurised terpene, a sulphurised Diels-Alder adduct, an alkyl sulphenyl N'N-dialkyl dithiocarbamates; or mixtures thereof. In one embodiment the sulphurised olefin includes a sulphurised olefin derived from propylene, isobutylene, pentene or mixtures thereof In one embodiment, the extreme pressure agent sulphur-containing compound includes a dimercaptothiadiazole or derivative, or mixtures thereof. Examples of the dimercaptothiadiazole include 2,5-dimercapto-1,3,4-thiadiazole or a hydrocarbyl-substituted 2,5-dimercapto-1,3,4-thiadiazole, or oligomers thereof. The oligomers of hydrocarbyl-substituted 2,5-dimercapto-1,3,4-thiadiazole typically form by forming a sulphur-sulphur bond between 2,5-dimercapto-1,3,4-thiadiazole units to form derivatives or oligomers of two or more of said thiadiazole units. Suitable 2,5-dimercapto-1,3,4-thiadiazole derived compounds include 2,5-bis(tert-nonyldithio)-1,3,4-thiadiazole or 2-tert-nonyldithio-5-mercapto-1,3,4-thiadiazole.

The number of carbon atoms on the hydrocarbyl substituents of the hydrocarbyl-substituted 2,5-dimercapto-1,3,4-thiadiazole typically include 1 to 30, or 2 to 20, or 3 to 16.

In one embodiment the extreme pressure agent includes a boron-containing compound. The boron-containing compound includes a borate ester (which in some embodiments may also be referred to as a borated epoxide), a borated alcohol, a borated dispersant or mixtures thereof. In one embodiment the boron-containing compound may be a borate ester or a borated alcohol.

The borate ester may be prepared by the reaction of a boron compound and at least one compound selected from epoxy compounds, halohydrin compounds, epihalohydrin compounds, alcohols and mixtures thereof. The alcohols include dihydric alcohols, trihydric alcohols or higher alcohols, with the proviso for one embodiment that hydroxyl groups are on adjacent carbon atoms, i.e., vicinal.

Boron compounds suitable for preparing the borate ester include the various forms selected from the group consisting of boric acid (including metaboric acid, $HBO_2$, orthoboric acid, $H_3BO_3$, and tetraboric acid, $H_2B_4O_7$), boric oxide, boron trioxide and alkyl borates. The borate ester may also be prepared from boron halides.

In one embodiment suitable borate ester compounds include tripropyl borate, tributyl borate, tripentyl borate, trihexyl borate, triheptyl borate, trioctyl borate, trinonyl borate and tridecyl borate.

In one embodiment the borate ester compounds include tributyl borate, tri-2-ethylhexyl borate or mixtures thereof.

In one embodiment, the boron-containing compound is a borated dispersant, typically derived from an N-substituted long chain alkenyl succinimide. In one embodiment the borated dispersant includes a polyisobutylene succinimide. Borated dispersants are described in more detail in U.S. Pat. Nos. 3,087,936; and 3,254,025.

In one embodiment the borated dispersant may be used in combination with a sulphur-containing compound or a borate ester.

In one embodiment the extreme pressure agent is other than a borated dispersant.

The number average molecular weight of the hydrocarbon from which the long chain alkenyl group was derived includes ranges of 350 to 5000, or 500 to 3000, or 550 to 1500. The long chain alkenyl group may have a number average molecular weight of 550, or 750, or 950 to 1000.

The N-substituted long chain alkenyl succinimides are borated using a variety of agents including boric acid (for example, metaboric acid, $HBO_2$, orthoboric acid, $H_3BO_3$, and tetraboric acid, $H_2B_4O_7$), boric oxide, boron trioxide, and alkyl borates. In one embodiment the borating agent is boric acid which may be used alone or in combination with other borating agents.

The borated dispersant may be prepared by blending the boron compound and the N-substituted long chain alkenyl succinimides and heating them at a suitable temperature, such as, 80° C. to 250° C., or 90° C. to 230° C., or 100° C. to 210° C., until the desired reaction has occurred. The molar ratio of the boron compounds to the N-substituted long chain alkenyl succinimides may have ranges including 10:1 to 1:4, or 4:1 to 1:3; or the molar ratio of the boron compounds to the N-substituted long chain alkenyl succinimides may be 1:2. An inert liquid may be used in performing the reaction. The liquid may include toluene, xylene, chlorobenzene, dimethylformamide or mixtures thereof.

In one embodiment the dispersant may be a post treated dispersant. The dispersant may be post treated with dimercaptothiadiazole, optionally in the presence of one or more of a phosphorus compound, a dicarboxylic acid of an aromatic compound, and a borating agent.

In one embodiment the post treated dispersant may be formed by heating an alkenyl succinimide or succinimide detergent with a phosphorus ester and water to partially hydrolyze the ester. The post treated dispersant of this type is disclosed for example in U.S. Pat. No. 5,164,103.

In one embodiment the post treated dispersant may be produced by preparing a mixture of a dispersant and a dimercaptothiadiazole and heating the mixture above about 100° C. The post treated dispersant of this type is disclosed for example in U.S. Pat. No. 4,136,043.

In one embodiment the dispersant may be post treated to form a product prepared comprising heating together: (i) a dispersant (typically a succinimide), (ii) 2,5-dimercapto-1,3,4-thiadiazole or a hydrocarbyl-substituted 2,5-dimercapto-1,3,4-thiadiazole, or oligomers thereof, (iii) a borating agent (similar to those described above); and (iv) optionally a dicarboxylic acid of an aromatic compound selected from the group consisting of 1,3 diacids and 1,4 diacids (typically terephthalic acid), or (v) optionally a phosphorus acid compound (including either phosphoric acid or phosphorous acid), said heating being sufficient to provide a product of (i), (ii), (iii) and optionally (iv) or optionally (v), which is soluble in an oil of lubricating viscosity. The post treated dispersant of this type is disclosed for example in International Application WO 2006/654726 A.

Examples of a suitable dimercaptothiadiazole include 2,5-dimercapto-1,3-4-thiadiazole or a hydrocarbyl-substituted 2,5-dimercapto-1,3-4-thiadiazole. In several embodiments the number of carbon atoms on the hydrocarbyl-substituent group includes 1 to 30, 2 to 25, 4 to 20, or 6 to 16. Examples of suitable 2,5-bis(alkyl-dithio)-1,3,4-thiadiazoles include 2,5-bis(tert-octyldithio)-1,3,4-thiadiazole 2,5-bis(tert-nonyldithio)-1,3,4-thiadiazole, 2,5-bis(tert-decyldithio)-1,3,4-thiadiazole, 2,5-bis(tert-undecyldithio)-1,3,4-thiadiazole, 2,5-bis(tert-dodecyldithio)-1,3,4-thiadiazole, 2,5-bis(tert-tridecyldithio)-1,3,4-thiadiazole, 2,5-bis(tert-tetradecyldithio)-1,3,4-thiadiazole, 2,5-bis(tert-pentadecyldithio)-1,3,4-thiadiazole, 2,5-bis(tert-hexadecyldithio)-1,3,4-thiadiazole, 2,5-bis(tert-heptadecyldithio)-1,3,4-thiadiazole, 2,5-bis(tert-octadecyldithio)-1,3,4-thiadiazole, 2,5-bis(tert-nonadecyldithio)-1,3,4-thiadiazole or 2,5-bis(tert-eicosyldithio)-1,3,4-thiadiazole, or oligomers thereof.

Friction modifiers (other than (a) a borated phospholipid, and (b) an amine salt of a phosphoric acid ester) include fatty phosphonate esters, reaction products from fatty carboxylic acids reacted with guanidine, aminoguanidine, urea or thiourea, and salts thereof, fatty amines, esters such as borated glycerol esters, fatty phosphites, fatty acid amides, fatty epoxides, borated fatty epoxides, alkoxylated fatty amines, borated alkoxylated fatty amines, metal salts of fatty acids, or fatty imidazolines, condensation products of carboxylic acids and polyalkylene-polyamines.

In one embodiment the lubricating composition may contain phosphorus- or sulphur-containing antiwear agents other than compounds described as an extreme pressure agent of the amine salt of a phosphoric acid ester described above. Examples of the antiwear agent may include a non-ionic phosphorus compound (typically compounds having phosphorus atoms with an oxidation state of +3 or +5), a metal dialkyldithiophosphate (typically zinc dialkyldithiophosphates), a metal mono- or di-alkylphosphate (typically zinc phosphates), or mixtures thereof.

The non-ionic phosphorus compound includes a phosphite ester, a phosphate ester, or mixtures thereof. A more detailed description of the non-ionic phosphorus compound include column 9, line 48 to column 11, line 8 of U.S. Pat. No. 6,103,673.

In one embodiment the lubricating composition of the invention further includes a dispersant. The dispersant may be a succinimide dispersant (for example N-substituted long chain alkenyl succinimides), a Mannich dispersant, an ester-containing dispersant, a condensation product of a fatty hydrocarbyl monocarboxylic acylating agent with an amine or ammonia, an alkyl amino phenol dispersant, a hydrocarbyl-amine dispersant, a polyether dispersant or a polyetheramine dispersant.

In one embodiment the succinimide dispersant includes a polyisobutylene-substituted succinimide, wherein the polyisobutylene from which the dispersant is derived may have a number average molecular weight of 400 to 5000, or 950 to 1600.

Succinimide dispersants and their methods of preparation are more fully described in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and U.S. Pat. Nos. 6,165,235, 7,238,650 and EP Patent Application 0 355 895 A.

Suitable ester-containing dispersants are typically high molecular weight esters. These materials are described in more detail in U.S. Pat. No. 3,381,022.

In one embodiment the dispersant includes a borated dispersant. Typically the borated dispersant includes a succinimide dispersant including a polyisobutylene succinimide, wherein the polyisobutylene from which the dispersant is derived may have a number average molecular weight of 400 to 5000. Borated dispersants are described in more detail above within the extreme pressure agent description.

Dispersant viscosity modifiers (often referred to as DVMs) include functionalised polyolefins, for example, ethylene-propylene copolymers that have been functionalized with the reaction product of maleic anhydride and an amine, a polymethacrylate functionalised with an amine, or esterified styrene-maleic anhydride copolymers reacted with an amine may also be used in the composition of the invention.

Corrosion inhibitors include fatty amines, 1-amino-2-propanol, octylamine octanoate, condensation products of dodecenyl succinic acid or anhydride and/or a fatty acid such as oleic acid with a polyamine.

Metal deactivators include derivatives of benzotriazoles (typically tolyltriazole), 1,2,4-triazoles, benzimidazoles, 2-alkyldithiobenzimidazoles or 2-alkyldithiobenzothiazoles. The metal deactivators may also be described as corrosion inhibitors.

Foam inhibitors include copolymers of ethyl acrylate and 2-ethylhexylacrylate and optionally vinyl acetate.

Demulsifiers include trialkyl phosphates, and various polymers and copolymers of ethylene glycol, ethylene oxide, propylene oxide, or mixtures thereof.

Pour point depressants include esters of maleic anhydride-styrene, polymethacrylates, polyacrylates or polyacrylamides.

Seal swell agents include Exxon Necton-37™ (FN 1380) and Exxon Mineral Seal Oil™ (FN 3200).

Industrial Application

The limited slip differential typically incorporates a self-contained lubricant supply isolated from the lubricant disposed in the differential housing or carrier. The self-contained lubricant of the limited slip differential is generally different from the lubricant supplied to a manual transmission or an automatic transmission fluid. In both the manual and automatic transmission systems not comprising a limited slip differential one lubricant is sufficient to lubricate all of the transmission constituents.

An axle gear may have any one of a number of different types of differential. A differential typically has three major functions. The first function is to transmit engine power to the wheels. The second function is to act as the final gear reduction in the vehicle, slowing the rotational speed from the transmission to the wheels. The third function is to transmit the power to the wheels while allowing them to rotate at different speeds. A number of differentials are known and include an open differential, a clutch-type limited slip differential, a viscous coupling differential, a Torsen differential and a locking differential. All of these differentials may be generically referred to as axle gears.

Axle gears typically require a lubricant. The lubricant formulation is dependent on the type of axle gear, and the operating conditions of the axle gear. For example an open differential axle gear is believed to require antiwear and/or extreme pressure additives. In contrast, a limited slip differential typically requires a friction modifier because in addition to an open differential (known from many axle fluids), a spring pack and a clutch pack are typically present. The clutch pack may contain one or more reaction plates (often made from steel) and one or more friction plates. The friction plates are known, and may be made from a number of materials including paper, carbon, graphite, steel and a composite.

The lubricating composition suitable for the limited slip differential may have a sulphur content in the range of 0.3 wt % to 5 wt %, or 0.5 wt % to 5 wt %, or 0.5 wt % to 3 wt % or 0.8 wt % to 2.5 wt %, or 1 wt % to 2 wt %. In one embodiment the lubricating composition suitable for the limited slip differential may be a fully formulated fluid or a top treat concentrate. When the lubricating composition is in the form of a top treat concentrate, the concentrate may be added at 0.2 wt % to 10 wt %, or 0.5 wt % to 7 wt % relative to the amount of lubricant in a limited slip differential.

The following examples provide illustrations of the invention. These examples are non exhaustive and are not intended to limit the scope of the invention.

EXAMPLES

Preparative Example 1 (EX1)

Preparation of oleyl malimide. 175 g of malic acid and 131 g of xylene are added to a 4-necked one-litre round bottom flask equipped with a nitrogen inlet, mechanical stirrer, Dean-Stark apparatus, Friedrichs condenser and thermowell. The resultant mixture is heated to 140° C. and 349 g of oleyl amine is added dropwise over a period of 4 hours via an addition funnel. The flask is then maintained at 140° C. for a further 10 hours, before removal of 43 g of water. Solvent is then removed under vacuum (2.67 Pa, or 20 mm Hg) over a period of two hours at 140° C. The reaction produces 419 g of product.

Preparative Example 2 (EX2)

Preparation of coco-alkyl malimide. The process used as described in EX1 is followed, except 332 g of cocoamine is reacted with 216 g of malic acid. The reaction produces 449 g of product, and 52 g of water.

Preparative Example 3 (EX3)

Preparation of dodecyl malimide. The process used as described in EX1 is followed, except 298 g of dodecylamine is reacted with 216 g of malic acid. The reaction produces 426 g of product, and 52 g of water.

Preparative Example 4 (EX4)

Preparation of N-(N',N'-ditallow amino propyl)malimide. 74.5 g of malic acid and 250 $cm^3$ of toluene are added to a 4-necked one-litre round bottom flask equipped with a nitrogen inlet, mechanical stirrer, Dean-Stark apparatus, Friedrichs condenser and thermowell. The resultant mixture is heated to 110° C. and 324.3 g of Duomeen™2HT (N,N-ditallow propylenediamine) is added dropwise over a period of 6 hours via an addition funnel. The contents of the flask are stirred for a further 2 hours at 110° C. The flask is then heated to about 115° C. for at least 16 hours. Solvent is then removed under vacuum (2.67 Pa, or 20 mm Hg) over a period of two hours at 110° C.

Preparative Example 5 (EX5)

Preparation of N-(N',N'-dicoco amino propyl)malimide. The reaction is similar to EX4, except N,N-ditallow propylenediamine has been replaced with 238.6 g of N,N-dicoco propylenediamine.

Axle Lubricants

Comparative Example 1

(CE1) is a commercially available axle fluid containing no additional friction modifier.

Comparative Example 2

(CE2) is a commercially available axle fluid containing 4 wt % of a commercially available phosphorus-containing friction modifier.

Axle Lubricant 1 (ALEX1) is a commercially available axle fluid containing 1.8 wt % of EX1.

Axle Lubricant 2 (ALEX2) is a commercially available axle fluid containing 1.8 wt % of EX2.

Axle Lubricant 3 (ALEX3) is a commercially available axle fluid containing 1.8 wt % of the product of EX3.

Axle Lubricant 4 (ALEX4) is a commercially available axle fluid containing 1.8 wt % of the product of EX4.

Axle Lubricant 5 (ALEX5) is a commercially available axle fluid containing 1.8 wt % of the product of EX5.

The lubricants (CE1 to CE3 and ALEX1 and ALEX2) are evaluated in a Full-Scale Low-Velocity Friction Apparatus (FSLVFA). The apparatus uses a clutch test specimen as defined by Haldex® HC 100.5. The test is run while varying the speed, temperature and pressure. The test consists of friction performance evaluations at the beginning and after a 17-hour durability stage. A break-in phase runs 10 minutes at 90° C. oil temperature, 16 rpm, and 7070 N load. The phase conditions the clutch system for the pre-durability performance evaluation. The pre-durability performance evaluation is achieved by ramping the speed from 0 to 5 rpm in 5 seconds, then back to zero. Load is set to two levels, 3535 N (newtons) and 7070 N, which correspond to the range of axial compressive load imposed by the axle's internal clutch pack. The above two loads are evaluated at three oil temperatures: 40° C., 90° C., and 120° C. The sample clutch pack undergoes a durability phase that involves running the test rig for 17 hours at 120° C. oil temperature, 7070 N load, and 16 rpm. The post-durability evaluation is then run using the same conditions as the pre-test evaluation. A more detailed description of the test procedure is provides in SAE Paper 2001-01-3270. The results obtained for CE1, CE2, ALEX1 and ALEX2 are as follows:

| | Pre Test Evaluation | | Post Test Evaluation | |
|---|---|---|---|---|
| Lubricant | Torque (Newton-meter) Value | Torque vs Time Graph Shape | Torque (Newton-meter) Value | Torque vs Time Graph Shape |
| CE1 | 50 | Smooth, linear | Range 30-65 | oscillating |
| CE2 | 45 | Smooth, linear | Range 35-50 | oscillating |

-continued

| | Pre Test Evaluation | | Post Test Evaluation | |
|---|---|---|---|---|
| Lubricant | Torque (Newton-meter) Value | Torque vs Time Graph Shape | Torque (Newton-meter) Value | Torque vs Time Graph Shape |
| ALEX1 | 45 | Smooth, linear | 40 | Smooth, linear |
| ALEX2 | 45 | Smooth, linear | 40 | Smooth, linear |

Footnote:
The torque analysis is performed in samples after the speed has reached the set point of 5 rpm between 5 and 7.5 seconds.

The results indicate that post-durability data of CE1 shows more oscillations than that of CE2. The post-durability data of ALEX1 and ALEX 2 have almost zero oscillations. The amount of oscillation in the torque curve indicates a large amount of stick-slip event which would lead to a large amount to noise. Both ALEX1 and ALEX2 show minimal amounts of oscillation and hence less noise than CE1 and CE2.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A method of lowering noise, vibration and harshness in a limited slip differential by lubricating the limited slip differential with a lubricating composition comprising (a) 0.2 wt % to 3 wt % of an N-substituted malimide, and (b) an oil of lubricating viscosity, wherein the N-substituted hydrocarbyl malimide is represented by the formula:

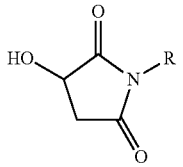

wherein R is a hydrocarbyl group containing 8 to 20, carbon atoms, with the proviso that when the N-substituted malimide comprises molecules with a hydrocarbyl group of less than 8 carbon atoms, then the N-substituted malimide is in the form of a mixture of N-substituted malimides and the hydrocarbyl groups in said mixture have an average total number of carbon atoms of at least 6, or wherein the N-substituted hydrocarbyl malimide is represented by the formula:

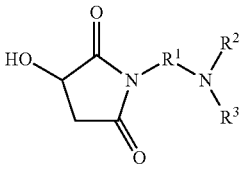

wherein $R^1$ is a hydrocarbylene typically containing 1 to 6, carbon atoms; and $R^2$ and $R^3$ are each independently hydrogen or a hydrocarbyl group containing 8 to 20 carbon atoms;

with the proviso that when the N-substituted malimide comprises molecules with a hydrocarbyl group of less than 8 carbon atoms, then the N-substituted malimide is in the form of a mixture of N-substituted malimides and the hydrocarbyl groups in said mixture have an average total number of carbon atoms of at least 6, and with the proviso that $R^2$ and $R^3$ are not simultaneously both hydrogen.

2. The method of claim 1 further comprising a sulphur-containing compound.

3. The method of claim 2, wherein the sulphur-containing compound is a dimercaptothiadiazole or derivative, or mixtures thereof.

4. The method of claim 3, wherein the sulphur-containing compound is a polysulphide or a sulphurised olefin.

5. The method of claim 4, wherein the lubricating composition further comprises a phosphorus-containing compound.

6. The method of claim 5, wherein the phosphorus containing compound is an amine salt of a phosphoric acid ester.

7. The method of claim 6, wherein the amine salt of a phosphoric acid ester is an amine salt of either (i) a hydroxy-substituted di- ester of phosphoric acid, or (ii) a phosphorylated hydroxy-substituted di- or tri- ester of phosphoric acid.

8. The method of claim 1, wherein the lubricating composition further comprises a boron-containing compound.

9. The method of claim 8, wherein the boron-containing compound is a borated dispersant, a borate ester or a borated phospholipid.

10. The method of claim 1, wherein the lubricating composition has a sulphur content in the range of 0.3 wt % to 5 wt %.

11. The method of claim 1, wherein $R^1$ comprises 3 carbon atoms.

* * * * *